US006081181A

United States Patent [19]

Kawase et al.

[11] Patent Number: 6,081,181

[45] **Date of Patent: *Jun. 27, 2000**

[54] THERMISTOR CHIPS AND METHODS OF MAKING SAME

[75] Inventors: Masahiko Kawase; Hidenobu Kimoto; Norimitsu Kito; Ikuya Taniguchi, all of Shiga, Japan

[73] Assignee: Murata Manufacturing Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,502

[22] Filed: Oct. 3, 1997

[30] Foreign Application Priority Data

Oct. 9, 1996 [JP] Japan ..... 8-268396

[51] Int. Cl.[7] ..... H01C 7/13

[52] U.S. Cl. ..... 338/22 R; 338/225 D; 338/313; 338/332

[58] Field of Search ..... 338/327, 332, 338/313, 22 R, 225 D

[56] References Cited

U.S. PATENT DOCUMENTS

| | | | |
|---|---|---|---|
| 3,645,785 | 2/1972 | Hentzschel | 428/620 |
| 4,764,844 | 8/1988 | Kato et al. . | |
| 5,257,003 | 10/1993 | Mahoney | 338/22 R |
| 5,294,910 | 3/1994 | Tani et al. | 338/306 |
| 5,339,068 | 8/1994 | Tsunoda et al. . | |
| 5,493,266 | 2/1996 | Sasaki et al. | 338/22 R |
| 5,534,843 | 7/1996 | Tsunoda et al. | 338/22 R |
| 5,699,607 | 12/1997 | McGuire et al. | 338/22 R |

FOREIGN PATENT DOCUMENTS

| | | | |
|---|---|---|---|
| 308306 | 3/1989 | European Pat. Off. | 338/22 R |
| 4029681 | 4/1992 | Germany . | |
| 5-109503 | 4/1993 | Japan | 338/22 R |
| 5-258906 | 10/1993 | Japan | 338/22 R |
| 9016074 | 12/1990 | WIPO | 338/22 R |

OTHER PUBLICATIONS

Patent Abstract of Japan, vol. 096, No. 009, Sep. 30, 1996.

*Primary Examiner*—Karl Easthom
*Attorney, Agent, or Firm*—Majestic, Parsons, Siebert & Hsue P.C.

[57] ABSTRACT

Electrodes on both ends of a thermistor chip element each have a first metal layer formed on the thermistor chip element and a second metal layer which has a smaller area than the first metal layer and is formed on the first metal layer such that the mutually opposite edge parts of the first metal layers are exposed. Third metal layers are formed over the second metal layers. A fourth metal layer may be formed between the first and second metal layers.

10 Claims, 3 Drawing Sheets

THERMISTOR CHIPS AND METHODS OF MAKING SAME

BACKGROUND OF THE INVENTION

This invention relates to thermistor chips with reduced fluctuations in the resistance values. This invention also relates to methods of making such thermistor chips.

As shown in FIGS. 14 and 15, conventional thermistor chips 1 are usually produced by forming electrodes 3 at both end parts of a thermistor chip block 2 having a negative temperature characteristic (NTC) made of a fired ceramic material having an oxide of a transition metal such as Mn, Co and Ni as its principal component. The electrodes 3 each comprise a first metal layer 3*a* formed by applying a paste of Ag or Ag/Pd on the end parts of the thermistor chip element 2 and then firing on it and a second metal layer 3*b* formed by applying a solder material on the surface of the first metal layer 3*a*.

Recently, thermistor chips of this kind are required to be miniaturized. From the point of view of resistance values, demands for thermistor chips with low resistance values are growing. Many problems arise, however, if one attempts to reduce the size of a thermistor chip as well as its resistance value. For example, small thermistor chip elements are difficult to handle, they are thin and they crack easily. As the separation between the electrodes 3 at both ends (indicated by letter "a" in FIG. 15) is reduced, a bridge-like structure of solder is likely to form.

For improving the efficiency of production, thermistor chip elements of the same size are sometimes used to produce thermistor chips with different resistance values by varying the size of the electrodes. In such a situation, the width of the electrodes 3 (indicated by letter "d" in FIG. 15) often becomes non-uniform, and it becomes necessary to provide land connectors with different shapes corresponding to different values of d. Depending on the shape of the connecting land, furthermore, the thermistor chip may even be caused to stand up at the time of soldering (or the formation of so-called "tombstones").

Moreover, there are generally large fluctuations in the normal-temperature resistance values (hereinafter simply referred to as the resistance values) of thermistors determined by the resistance of the thermistor chip element itself and the positions of the terminal electrodes 3. The so-called "3cv" value (an index of fluctuations defined as $100\times3\ \sigma/(\text{average value})$ where $\sigma$ indicates the standard deviation of fluctuation within a lot) for the resistance values of thermistor chips is conventionally as large as 5–20% and it was too costly to obtain products with a smaller deviation of less than 1%.

SUMMARY OF THE INVENTION

It is therefore an object of this invention to overcome the problems described above and to provide thermistor chips of which the resistance values can be made smaller with a small fluctuation even if thermistor chip elements of the same size are used.

It is another object of this invention to provide such thermistor chips to which solder can be applied uniformly without producing tombstones.

It is still another object of this invention to provide a method of producing such thermistor chips.

A thermistor chip embodying this invention, with which the above and other objects can be accomplished, may be characterized not only as comprising electrodes which are formed at both end parts of a thermistor chip element but also wherein these electrodes comprise first metal layers, second metal layers which are formed on the surfaces of the first metal layers, have a smaller surface area than the first metal layers and are formed such that mutually opposite end parts of the first metal layers will be exposed, and third metal layers formed so as to overlap the surfaces of the second metal layers. A fourth metal layer or layers may be further provided over at least one of the first metal layers, extending farther on the surface of the thermistor chip element from the edge part of the first metal layer. It is preferable to have a fourth metal layer between the first and second metal layers of at least one of the electrodes at both end parts, extending beyond the edge part of the first metal layer.

It is further preferable that the first and fourth metal layers have resistance against soldering heat, that the second metal layers have wettability to solder and in particular that the first and fourth metal layers comprise thin-film electrodes formed with one or more layers of Cr, Ni, Al, W or their alloys. The second metal layers preferably comprise thin-film electrodes of Ni or a Ni alloy, and the third metal layers preferably form electrodes comprising Sn, Sn—Pb alloy or Ag. The first, second and fourth metal layers are preferably thin-film electrodes formed by dry soldering.

A method for producing a thermistor chip embodying this invention may be characterized as comprising the steps of forming first metal layers on both end parts of a thermistor chip, measuring a normal-temperature resistance value of the thermistor chip between the first metal layers, forming a fourth metal layer on the surface of at least one of the first metal layers, extending onto the surface of the thermistor chip element from the edge part of this first metal layer so as to make the normal-temperature resistance value smaller, forming a second metal layer with a smaller area than the first (or fourth) metal layer on the surface of the first (or fourth) metal layer such that the end part of the mutually opposite first (or fourth) metal layer is exposed, and forming a third metal layer over the second metal layer. Preferably, the fourth metal layer comprises one or more thin-film layers of Cr, Ni, Al, W or their alloys, the second metal layer comprises a thin-film layer of Ni or a Ni alloy, and the third metal layer comprises an electrode of Sn, Sn—Pb alloy or Ag. It is possible by such a method to obtain thermistor chips with a small fluctuation in their resistance values which can be soldered easily although their resistance values are small.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, like components may be indicated by the same numeral even if belonging to different thermistor chips and repetitive explanations may be omitted for simplifying the disclosure. It is also to be reminded that these figures are intended to be schematic and not true to scale. The metal layers, in particular, are generally much thinner than the thickness of the thermistor chip element, and hence the indications of distances in the figures are provided by ignoring the thickness of the layers.

DETAILED DESCRIPTION OF THE INVENTION

Figure 1:
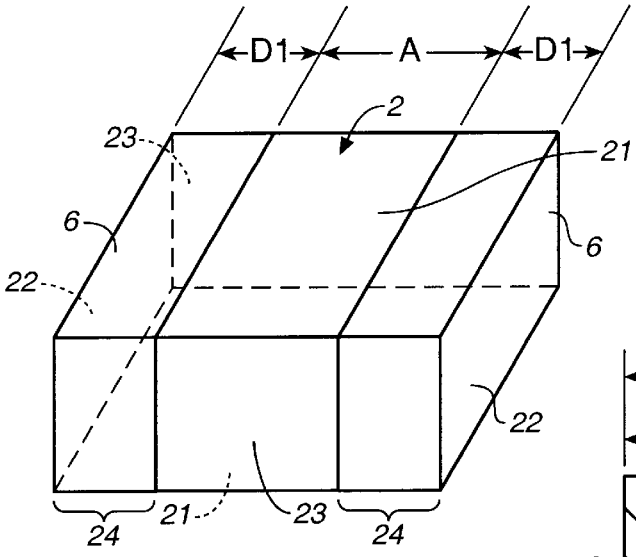
FIG. 1 is a diagonal view of an intermediate product obtained by forming first metal layers on a thermistor chip element during the production of a thermistor chip according to a first or second embodiment of this invention.

A first embodiment of the invention will be described with reference to FIGS. 1 and 2. As shown in FIG. 1, first metal layers 6, which are thin-film layers of a material with resistance against soldering heat such as Ni, are first formed at both end parts of a thermistor chip element 2. The thermistor chip element 2 is planar, having a pair of main surfaces 21, a pair of end surfaces 22 extending between these two main surfaces 21 and a pair of side surfaces 23 extending between the main surfaces 21 and also between the two end surfaces 22. Throughout herein, the term "end parts" will be used regarding the thermistor chip element 2 to include both the pair of end surfaces 22 and end portions (indicated by numeral 24) of the main surfaces 21 and the side surfaces 23 of the thermistor chip element 2 adjacent to these end surfaces 22. In order to obtain a small resistance value by using this thermistor chip element 6, the first metal layers 6 are formed such that their edges 61 protruding towards each other will be separated by a specified distance indicated by symbol A in FIG. 1. The distance between the end surfaces of the thermistor chip element 2 and the edges 61 of the first metal layers 6 is indicated by symbol D1.

Figure 2:
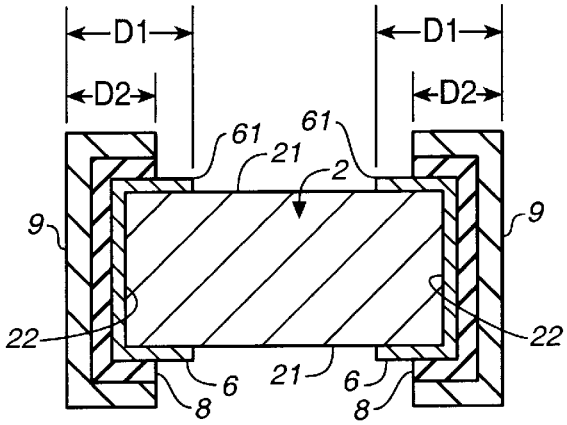
FIG. 2 is a sectional view of a thermistor chip according to a first embodiment of this invention.

Next, second metal layers 8 are formed, as shown in FIG. 2, on the surfaces of the first metal layers 6 covering the end surfaces of the thermistor chip element 2 so as to expose mutually opposite edge parts with width D1–D2 (where D2 is shorter than D1 but large enough for the application of solder) of the first metal layer 6. The second metal layer 8 is a thin-film electrode of a material having wettability to solder and resistance against soldering heat such as Ni and may be formed by sputtering. Thereafter, third metal layers 9, such as of Ag, are formed so as to overlap the surfaces of the second metal layers 8 for preventing deterioration of their solder wettability due, for example, to their surface oxidation.

Thus, thermistor chips according to the first embodiment of this invention, as described above, are characterized as being provided with electrodes composed of three metal layers over the both end parts a thermistor chip element wherein the width D2 of the areas to be wetted by solder can be made constant independent of the separation A for adjusting the resistance value. Although the first embodiment of the invention was described above by way of one example, it is not intended to limit the scope of the invention. The first metal layers 6 may comprise a metal other than Ni such as Cr, Al, W and their alloys or be formed as a single layer or more than one layer of such materials. The second metal layers 8 may be thin-film layers of a Ni alloy. The third metal layers 9 may comprise an alloy of Sn or Sn—Pb and may be thick-film layers formed by subjecting an electrode paste to a firing process.

A second embodiment of the invention is described next with reference to FIGS. 3 and 4 wherein components which may be identical to those described above with reference to the first embodiment of the invention are indicated by the same symbols and may not be repetitively explained in detail.

According to the second embodiment of this invention, resistance of thermistor chip elements (such as shown at 2 in FIG. 1) is measured by using the first metal layers 6 as electrodes for the measurement, and these chip elements are divided according to the measured resistance values into ranks n (n being a dummy index), each associated with a different resistance value Rn. Next, overlying metal layers (herein referred to as "the fourth metal layers" for convenience) 7 are formed as shown in FIG. 3 over and so as to completely cover the surfaces of the first metal layers 6 such that their mutually opposite edges will be separated by a distance B shorter than the separation A between the first metal layers 6 as described above with reference to FIG. 1 and that the thermistor chip element 2 will have a specified resistance value which is smaller than Rn. The fourth metal layers 7 are thin-film layers of a material with resistance against soldering heat such as Ni and are formed for the purpose of reducing the resistance of the chip element 2. Alternatively, the fourth metal layers 7 may comprise metals other than Ni, such as Cr, Al, W and their alloys and may be of a single-layer or multi-layer structure. Thereafter, as done according to the first embodiment of this invention, second metal layers 8 and third metal layers 9 are formed sequentially over the fourth metal layers 7 with width D2 sufficiently large for soldering while the mutually opposite edges of the fourth metal layers 7 are exposed, as shown in FIG. 4, thereby obtaining a thermistor chip according to the second embodiment of the invention.

A third embodiment of this invention is explained with reference to FIGS. 5 and 6. As can be seen easily, this embodiment is different from the second embodiment in that the fourth metal layer 7 is formed only on one side. So, equivalent components are indicated by the same numerals in FIGS. 5 and 6 as in FIGS. 3 and 4.

Figure 5:
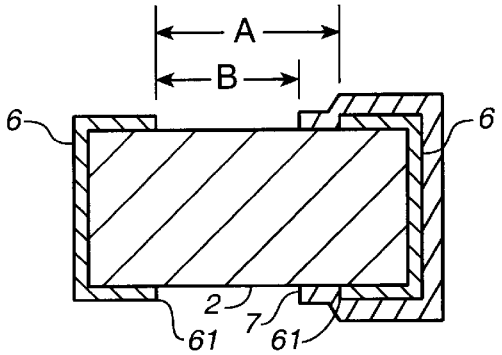
FIG. 5 is a sectional view of an intermediate product obtained by forming first and fourth metal layers during the production of a thermistor chip according to a third embodiment of the invention.
Figure 6:
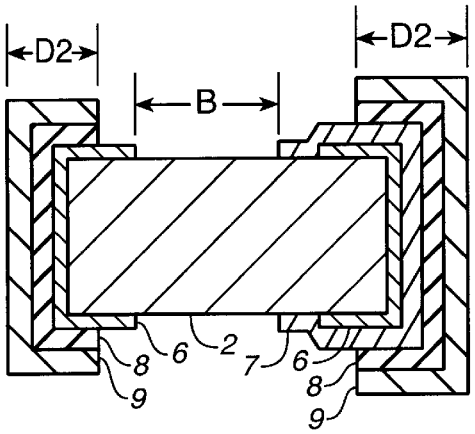
FIG. 6 is a sectional view of a thermistor chip according to the third embodiment of the invention.

Thus, as explained above in connection with the second embodiment of the invention, the fourth metal layer 7 is formed, say, as a thin-film Ni layer as shown in FIG. 5, covering one of the first metal layers 6 and leaving a distance of B between the edge of the fourth metal layer 7 and the opposite edge 61 part of the first metal layer 6 in order to adjust the resistance of the thermistor chip element 2 (classified first to rank n) to become equal to a specified small resistance value R. Thereafter, a second metal layer 8 and a third metal layer 9 are formed sequentially over the fourth metal layer 7 with width D2 sufficiently large for soldering while exposing the mutually opposite edges of the fourth metal layers 7 and one of the first metal layers 6 on the opposite side, as shown in FIG. 6, thereby obtaining a thermistor chip according to the third embodiment of the invention.

A fourth embodiment of this invention is explained with reference to FIGS. 7 and 8. As can be seen easily by comparing with FIG. 5, this embodiment is similar to the third embodiment in that the fourth metal layer 10 is formed to cover the edge 61 of only one of the mutually opposite first metal layers 6. So, equivalent components are indicated by the same numerals in FIGS. 7 and 8 as in FIGS. 5 and 6.

Figure 7:
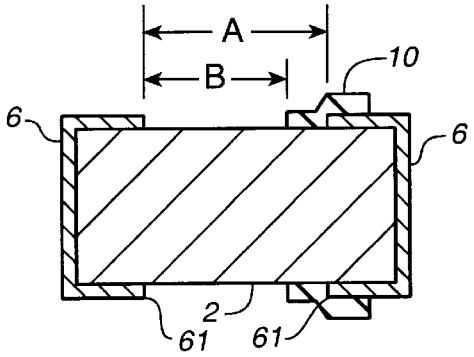
FIG. 7 is a sectional view of an intermediate product obtained by forming first and fourth metal layers during the production of a thermistor chip according to a fourth embodiment of this invention.
Figure 8:
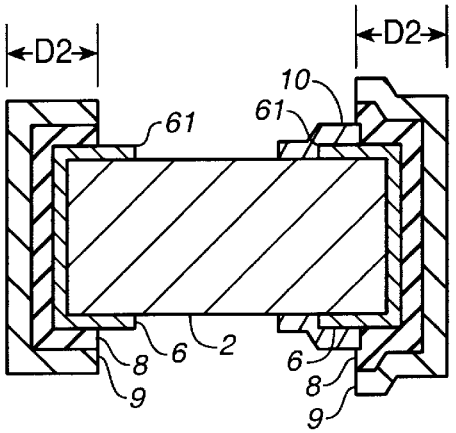
FIG. 8 is a sectional view of a thermistor chip according to the fourth embodiment of the invention.

Thus, as explained above in connection with the third embodiment of the invention, the fourth metal layer 10 is formed, say, as a thin-film Ni layer as shown in FIG. 7, covering one of the mutually opposite end parts of the two first metal layers 6 and leaving a distance of B between the edge of the fourth metal layer 10 and the opposite edge 61 of the first metal layer 6 in order to adjust the resistance of the thermistor chip element 2 (classified first to rank n) to become equal to a specified small resistance value R. Thereafter, a second metal layer 8 and a third metal layer 9 are formed sequentially over the fourth metal layer 10 with width D2 sufficiently large for soldering while exposing the mutually opposite edges of the fourth metal layers 10 and the opposite first metal layers 6, as shown in FIG. 8, thereby obtaining a thermistor chip according to the fourth embodiment of the invention.

A fifth embodiment of this invention is explained with reference to FIG. 9. As can be seen easily by comparing with FIG. 5, this embodiment is similar to the third embodiment in that the fourth metal layer 11 is formed to cover only a portion of the edge 61 of one of the mutually opposite first metal layers 6. Other equivalent components are indicated by the same numerals in FIG. 9 as in FIGS. 5 and 6.

Figure 9:
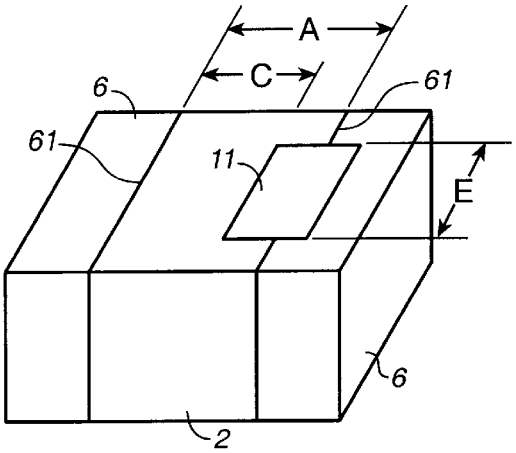
FIG. 9 is a diagonal view of an intermediate product obtained by forming first and fourth metal layers during the production of a thermistor chip according to a fifth embodiment of the invention.

As explained above in connection with the third embodiment of the invention, the fourth metal layer 11 is formed, say, as a thin-film Ni layer as shown in FIG. 9, covering a portion of length E of the edge part of one of the mutually opposite end parts of the first metal layers 6 and leaving a distance of C between the edge of the fourth metal layer 11 and the opposite edge 61 of the first metal layer 6 in order to adjust the resistance of the thermistor chip element 2 (classified first to rank n) to become equal to a specified small resistance value R.

Next, as explained above with reference to FIG. 6, a second metal layer 8 and a third metal layer 9 are formed sequentially over the thermistor chip element 2 shown in FIG. 9 over widths of D2 sufficiently large for soldering from both its side surfaces while exposing the mutually opposite edges of the fourth metal layer 11 and the opposite first metal layer 6, thereby obtaining a thermistor chip according to the fifth embodiment of the invention.

Although FIG. 9 shows a particular example of the fifth embodiment wherein the fourth metal layer 11 is formed on only one of the side surfaces of the thermistor chip element 2, a similar fourth metal layer may be formed on two or three side surfaces to adjust the resistance value R of the thermistor chip.

A sixth embodiment of the invention is explained with reference to FIG. 10. As can be seen easily by comparing with FIG. 1, this embodiment is similar to the first embodiment except its first metal layers 12 are formed only on the upper and lower surfaces and not on the side surfaces of the end parts of a thermistor chip element 2. Other equivalent components are indicated by the same numerals in FIG. 10 as in FIGS. 1 and 2.

As explained above in connection with the first embodiment of the invention, the first metal layers 12 are formed, say, by sputtering as thin-film Ni layers having resistance against soldering heat, at both end parts of the thermistor chip element 2 and by leaving a separating distance of A between the mutually opposite edge parts of the first metal layers 12 on the upper and lower surfaces such that a specified small resistance value R can be obtained by using the thermistor chip element 2.

Next, as explained above with reference to FIG. 2, second metal layers 8 and third metal layers 9 are formed sequentially over widths of D2 sufficiently large for soldering from the both end surfaces of the thermistor chip element 2 while exposing mutually opposite edge parts of the first metal layers 12, thereby obtaining a thermistor chip according to the sixth embodiment of the invention.

Figure 10:
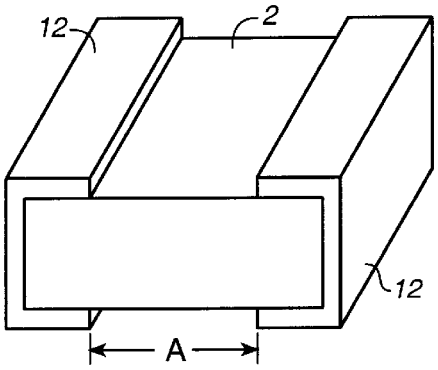
FIG. 10 is a diagonal view of an intermediate product obtained by forming first metal layers during the production of a thermistor chip according to a sixth embodiment of the invention.

With a thermistor chip according to the sixth embodiment of the invention, fourth metal layers as described above with reference to the second through fifth embodiments of the invention may be formed between the first and second metal layers 12 and 8 for adjusting the resistance value of the thermistor chip element 2 shown in FIG. 10.

The invention has been described above with reference to thermistor chip elements 2 of the kind not having any internal electrode. Since this invention is applicable to situations where use is made of a thermistor chip element having inner electrodes, however, such examples will be described next with reference to FIGS. 11–13.

Figure 11:
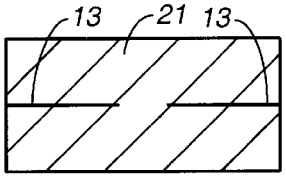
FIG. 11 is a sectional view of a thermistor chip element with inner electrodes which may be used for the production of thermistor chips according to the first through sixth embodiments of the invention.

FIG. 11 shows a thermistor chip element 21 having a pair of inner electrodes 13 which are disposed on a same plane inside the element 21 and are each connected electrically to a corresponding one of the first metal layers (not shown in FIG. 11). The resistance value of this thermistor chip element 21 is determined by the positions and sizes of not only the inner electrodes 13 but also the first or fourth metal layers. Since the (first or fourth) electrodes are formed on the surface of the thermistor chip element 2 according to this invention, the resistance value can be adjusted so as to become smaller.

Figure 12:
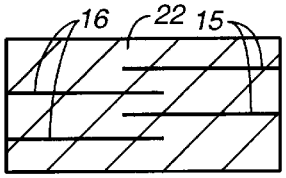
FIG. 12 is a sectional view of another thermistor chip element with inner electrodes which may be used for the production of thermistor chips according to the first through sixth embodiments of the invention.

FIG. 12 shows another thermistor chip element 22 having a plurality of inner electrodes 15 and 16 which are not in coplanar relationship. These inner electrodes 15 and 16, too, are each connected electrically to a corresponding one of the first metal layers (not shown) on the end surfaces of the chip element 22.

Figure 13:
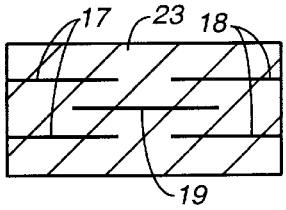
FIG. 13 is a sectional view of still another thermistor chip element with inner electrodes which may be used for the production of thermistor chips according to the first through sixth embodiments of the invention.
Figure 14:
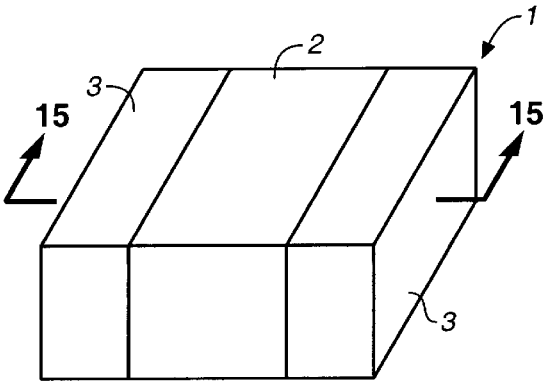
FIG. 14 (PRIOR ART)
FIG. 14 is a diagonal view of a prior art thermistor chip.
Figure 15:
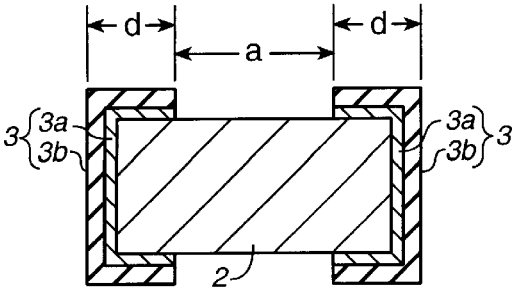
FIG. 15 (PRIOR ART)
FIG. 15 is a sectional view of the prior art thermistor chip of FIG. 14 taken along line 15—15.

FIG. 13 shows still another thermistor chip element 23 having inside thereof a plurality of inner electrodes 17 and 18 which are in coplanar relationship and each connected electrically to a corresponding one of the first metal layers (not shown) on the end surfaces, as well as an unconnected inner electrode 19 which is formed on a different plane from and in an apparently insulated relationship with the other inner electrodes 17 and 18.

These thermistors 21, 22 and 23, too, may be used in the place of the thermistor chips 2 described above with reference to FIGS. 1–10.

The invention will be described next with reference to actual tests carried out according to its second embodiment explained above with reference to FIG. 4. In this experiment, thermistor chip elements 2 with length 2.0 mm, width 1.2 mm and height 0.8 mm were prepared and first metal layers 6 comprising thin-film Ni layers of thickness 0.4 μm were formed on both end parts as shown in FIG. 1 such that the separation A between their mutually opposite edge parts was 1.3 mm. Next, these first metal layers 6 were used as electrodes to measure the resistance value of each of these thermistor chip elements 2.

These thermistor chip elements 2 of a lot having average resistance 10KΩ with the "3cv" of 15% were divided into eleven ranks, as shown in Table 1, each corresponding to a range of 0.3KΩ in resistance. The average resistance values each corresponding to associated one of the ranks are also shown in Table 1.

Figure 3:
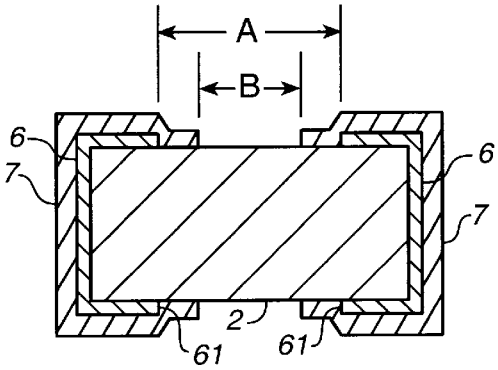
FIG. 3 is a sectional view of another intermediate product obtained by forming fourth metal layers on the intermediate product of FIG. 1 for the production of a thermistor chip according to the second embodiment of this invention.

Next, thin-film Ni layers of thickness 0.4 μm were formed as the fourth metal layers 7 as shown in FIG. 3 on each of the thermistor chip elements 2 such that their resistance values will fall within a specified range R=8±0.2KΩ. The distance B between the end parts of the fourth metal layers 7 was selected for this purpose, depending on the resistance value of each rank as shown in Table 1.

Figure 4:
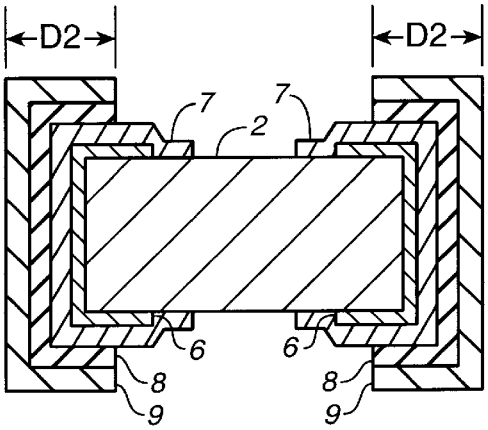
FIG. 4 is a sectional view of a thermistor chip according to the second embodiment of the invention.

Finally, thin-film Ni—Cu layers of thickness 0.8 μm were formed as the second metal layers 8 at both end parts of the thermistor chip element 2, and thin-film Ag layers of thickness 0.8 μm were formed by sputtering as the third metal layers 9 on the surfaces of the second metal layers 8, as shown in FIG. 4 so as to adjust the resistance value of the thermistor chip. The measured resistance values of the thermistor chips thus obtained are also shown in Table 1.

TABLE 1

| Rank | Range of Resistance (KΩ) | A (mm) | Average Resistance (KΩ) | B (mm) | Average Resistance (KΩ) After Adjustment |
|---|---|---|---|---|---|
| 1 | 11.5< | 1.3 | 11.65 | 0.91 | 8.01 |
| 2 | 11.5–11.2 | " | 11.32 | 0.93 | 8.12 |
| 3 | 11.2–10.9 | " | 11.64 | 0.95 | 8.03 |
| 4 | 10.9–10.6 | " | 10.76 | 0.98 | 8.19 |
| 5 | 10.6–10.3 | " | 10.44 | 1.01 | 8.00 |
| 6 | 10.3–10.0 | " | 10.10 | 1.04 | 8.06 |
| 7 | 10.0–9.7 | " | 9.85 | 1.07 | 8.04 |
| 8 | 9.7–9.4 | " | 9.56 | 1.10 | 8.12 |
| 9 | 9.4–9.1 | " | 9.24 | 1.13 | 7.91 |
| 10 | 9.1–8.8 | " | 8.99 | 1.17 | 7.85 |
| 11 | 8.8–8.5 | " | 8.72 | 1.21 | 7.81 |

As can be understood from Table 1, the difference between the maximum and minimum resistance values of the thermistor chips in this lot right after the first metal layers were formed was about 3KΩ but this was reduced to about 0.38KΩ after the fourth metal layers were formed to reduce the separation distance from A to B for each rank.

Advantages which can be achieved by the present invention include the following:

(1) Since the first metal layers extend farther than the second metal layers towards the center of the thermistor chip element, the resistance value of the thermistor chip is determined by the first metal layers and hence thermistor chips with smaller resistance values can be obtained;

(2) Since the fourth metal layers are formed over the first metal layers to adjust the resistance values, thermistor chips with smaller standard variations in the fluctuation of their resistance values can be obtained easily;

(3) Since the second and third metal layers for soldering are formed with the same size although the separating distances between the mutually opposite edges of the first or fourth metal layers are varied according to a specified resistance value, the areas for applying solder for attaching the thermistor chip to a circuit board can remain the same, occurrence of tombstones and solder bridges between electrodes being thereby prevented;

(4) Since the second metal layers have resistance against soldering heat and are covered by the third metal layers, their wettability can be maintained and the thermistor chip can be soldered easily; and (5) Since the first, second and fourth metal layers can be formed by a dry soldering method, electrical properties and mechanical strength of the thermistor chips are not adversely affected although the ceramic element is exposed unprotected.

The disclosure provided above is intended to be interpreted broadly. Many modifications and variations are to be included within the scope of the invention. For example, the thermistor chip elements referred to in the description above may be of positive temperature characteristics.

What is claimed is:

1. A thermistor chip comprising:

a planar thermistor chip element having a pair of main surfaces, a pair of mutually oppositely facing end surfaces extending between said main surfaces and a pair of side surfaces extending between said main surfaces and between said end surfaces; and a pair of electrodes, each including a single first metal layer, a second metal layer and a third metal layer, said first metal layer being formed directly on one of said end surfaces and end portions of said main surfaces adjacent the one end surface, said second metal layer being formed over said first metal layer, said third metal layer being formed over said second metal layer, the first metal layers of said electrodes on each of said pair of main surfaces having mutually opposite edges which face and are separated from each other and are not overlapped by the second metal layer;

wherein at least one of said electrodes further includes a fourth metal layer which is formed over the edge of said first metal layer on at least one of said main surfaces of said thermistor chip element and extends so as to directly contact said one main surface of said thermistor chip element.

2. The thermistor chip of claim 1 wherein said first metal layer and said fourth metal layer each comprise one or more layers each comprising a material selected from the group consisting of Cr, Ni, Al, W and alloys thereof.

3. The thermistor chip of claim 1 wherein said second metal layer comprises a thin-film electrode of Ni or a Ni alloy.

4. The thermistor chip of claim 1 wherein said third metal layer comprises a material selected from the group consisting of Sn, Sn—Pb alloys and Ag.

5. The thermistor chip of claim 1 wherein said first metal layers of said pair of electrodes are formed on said end surfaces and end portions of said main surfaces and said side surfaces and wherein said second metal layers are formed over said first metal layers on said end surfaces and only partially on said end portions of said main surfaces and said side surfaces.

6. A thermistor chip comprising:

a planar thermistor chip element having a pair of main surfaces, a pair of mutually oppositely facing end surfaces extending between said main surfaces and a pair of side surfaces extending between said main surfaces and between said end surfaces; and a pair of electrodes, each including a single first metal layer, a second metal layer and a third metal layer, said first metal layer being formed directly on one of said end surfaces and end portions of said main surfaces adjacent the one end surface, said second metal layer being formed over said first metal layer, said third metal layer being formed over said second metal layer, the first metal layers of said electrodes on each of said pair of main surfaces having mutually opposite edges which face and are separated from each other and are not overlapped by the second metal layer;

wherein at least one of said electrodes further includes a fourth metal layer which is formed between said first metal layer and said second metal layer at least over the edge part of said first metal layer and extending so as to directly contact at least one of said main surfaces of said thermistor chip element.

7. The thermistor chip of claim 6 wherein said first metal layer and said fourth metal layer each comprise one or more layers each comprising a material selected from the group consisting of Cr, Ni, Al, W and alloys thereof.

8. The thermistor chip of claim 6 wherein said second metal layer comprises a thin-film electrode of Ni or a Ni alloy.

9. The thermistor chip of claim 6 wherein said third metal layer comprises a material selected from the group consisting of Sn, Sn—Pb alloys and Ag.

10. The thermistor chip of claim 6 wherein said first metal layers of said pair of electrodes are formed on said end surfaces and end portions of said main surfaces and said side surfaces and wherein said second metal layers are formed over said first metal layers on said end surfaces and only partially on said end portions of said main surfaces and said side surfaces.

* * * * *